US009022911B2

(12) United States Patent
Goldberg

(10) Patent No.: US 9,022,911 B2
(45) Date of Patent: May 5, 2015

(54) FITNESS BOARD

(75) Inventor: Johnny Goldberg, Montecito, CA (US)

(73) Assignee: Five Giri, Inc., Agoura Hills, CA (US)

( * ) Notice: Subject to any disclaimer, the term of this patent is extended or adjusted under 35 U.S.C. 154(b) by 385 days.

(21) Appl. No.: 13/528,658

(22) Filed: Jun. 20, 2012

(65) Prior Publication Data

US 2012/0329619 A1 Dec. 27, 2012

Related U.S. Application Data

(60) Provisional application No. 61/499,413, filed on Jun. 21, 2011.

(51) Int. Cl.

*A63B 21/04* (2006.01)
*A63B 21/00* (2006.01)
*A63B 21/002* (2006.01)

(52) U.S. Cl.

CPC ..... *A63B 21/04* (2013.01); *A63B 21/0442* (2013.01); *A63B 21/1419* (2013.01); *A63B 21/1457* (2013.01); *A63B 21/1473* (2013.01); *A63B 2210/50* (2013.01); *A63B 2225/093* (2013.01); *A63B 21/0023* (2013.01)

(58) Field of Classification Search

CPC ..... A63B 21/0442; A63B 21/078; A63B 21/1457

USPC ..... 482/104, 121–123, 129–130, 133–134, 482/140, 142, 145, 910, 27–29, 52–53; 128/845

See application file for complete search history.

(56) References Cited

U.S. PATENT DOCUMENTS

| | | | | |
|---|---|---|---|---|
| 695,538 | A | 3/1902 | Clairmont | |
| 3,664,666 | A * | 5/1972 | Lloyd | 482/133 |
| 3,707,284 | A * | 12/1972 | Waldeck | 482/130 |
| 4,136,868 | A | 1/1979 | Hogue | |
| 4,241,915 | A | 12/1980 | Noble | |
| D279,810 | S | 7/1985 | Noble | |
| 5,472,401 | A | 12/1995 | Rouillard et al. | |
| 5,605,526 | A * | 2/1997 | Hatfield | 482/142 |
| 5,649,886 | A * | 7/1997 | Danylieko | 482/142 |
| 5,769,767 | A | 6/1998 | Hochberg et al. | |
| 5,795,276 | A * | 8/1998 | Almeda | 482/142 |
| 6,634,998 | B2 * | 10/2003 | Siaperas | 482/142 |
| 7,361,123 | B1 | 4/2008 | Krull | |
| 7,651,452 | B2 | 1/2010 | Weir et al. | |
| 7,803,097 | B2 | 9/2010 | Araujo | |
| 8,298,126 | B2 | 10/2012 | Berc | |
| 2004/0147381 | A1 * | 7/2004 | Cervantes Gallego | 482/142 |
| 2008/0051274 | A1 * | 2/2008 | Greene | 482/142 |
| 2008/0119338 | A1 * | 5/2008 | Prsala | 482/142 |
| 2008/0248937 | A1 | 10/2008 | Stillwell | |
| 2009/0270236 | A1 | 10/2009 | Berc | |
| 2011/0039668 | A1 | 2/2011 | McCall, Jr. | |
| 2012/0021181 | A1 * | 1/2012 | Thompson | 428/159 |

* cited by examiner

*Primary Examiner* — Loan H Thanh
*Assistant Examiner* — Jennifer M Deichl
(74) *Attorney, Agent, or Firm* — Cislo & Thomas, LLP

(57) ABSTRACT

An exercise or fitness board having a deck adjustably attached to a base to adjust the angle of incline of the deck relative to the base, and a plurality of straps attached to the deck for the user to grasp for balance and exercise. The deck and/or base contains various contours, scallops, cutouts, and the like to facilitate comfortable and varied positioning of the body. A rail and/or channel may be placed on the underside and along the perimeter of the board to facilitate grip. A pad or mat may be placed on top of the board and/or base for comfort, stability, and protection.

5 Claims, 3 Drawing Sheets

FITNESS BOARD

CROSS-REFERENCE TO RELATED APPLICATION

This patent application claims the benefit of U.S. Provisional Patent Application No. 61/499,413, entitled "Fitness Board," filed Jun. 21, 2011, which application is incorporated in its entirety here by this reference.

BACKGROUND OF THE INVENTION

1. Technical Field

This invention relates to an exercise platform upon which a variety of exercises can be performed.

2. Background Art

Staying fit and healthy does not require sporting ripped muscles, a six pack, and 5% body fat. What it does require is regularly pushing a variety of muscle groups beyond the normal level of exertion encountered in daily living. Most exercise devices that allow a user to exercise a variety of muscle groups tend to be large, cumbersome equipment with elaborate pulley systems, cables, and weights. The simpler exercise devices tend to isolate on only a few muscle groups such as the abdominals or the legs.

Some exercises, such as yoga and tai chi, do not require any equipment except for a mat. Although a variety of muscle groups may be exercised, the intensity and range of the exercise is limited. For example, the range of movement is limited to the space above, in front of, behind, and to the sides of the exerciser.

Thus, there is a need for an exercise device that is simple in construction, yet allows for a variety of muscle groups to be exercise with varying intensity and range.

BRIEF SUMMARY OF INVENTION

The present invention is directed to an exercise or fitness board that allows for a variety of exercises with varying intensity and increased range of motion. The fitness board comprises a deck adjustably attached to a base. Both the deck and base are elevated off the ground so that negative space, i.e. the space below the board, can be utilized to increase the range of motion of an exercise or stretch.

The deck is adjustable to change the angle of incline of the deck relative to the base so as to increase or decrease the intensity of an exercise.

Various straps and/or ropes can be attached to the deck and/or the base to provide stability and/or resistance during exercise or stretch.

The deck and/or base may further comprise various contours, scallops, cutouts, and the like to facilitate comfortable and varied positioning of the body.

The exercise board may further comprise a rail and/or channel on the underside and along the perimeter of the board to facilitate grip.

The exercise board may further comprise a mat for comfort, stability, and protection.

To facilitate transportation storage of the fitness board, the legs, deck, and base may be foldable.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The fitness board 100 is an exercise device that provides an inclinable platform or deck 102 upon which a user utilizes the forces of gravity and his own body positioning to conduct a variety of different exercises to strengthen and develop a variety of different muscle groups. Other exercise devices require heavy, non-transportable systems in order to provide varied exercises. Exercise devices that are simpler in construction only focus on a few targeted muscle groups, such as the legs or abdominals There is no simple device that allows the variety of exercises that the present fitness board 100 provides.

Figure 1:
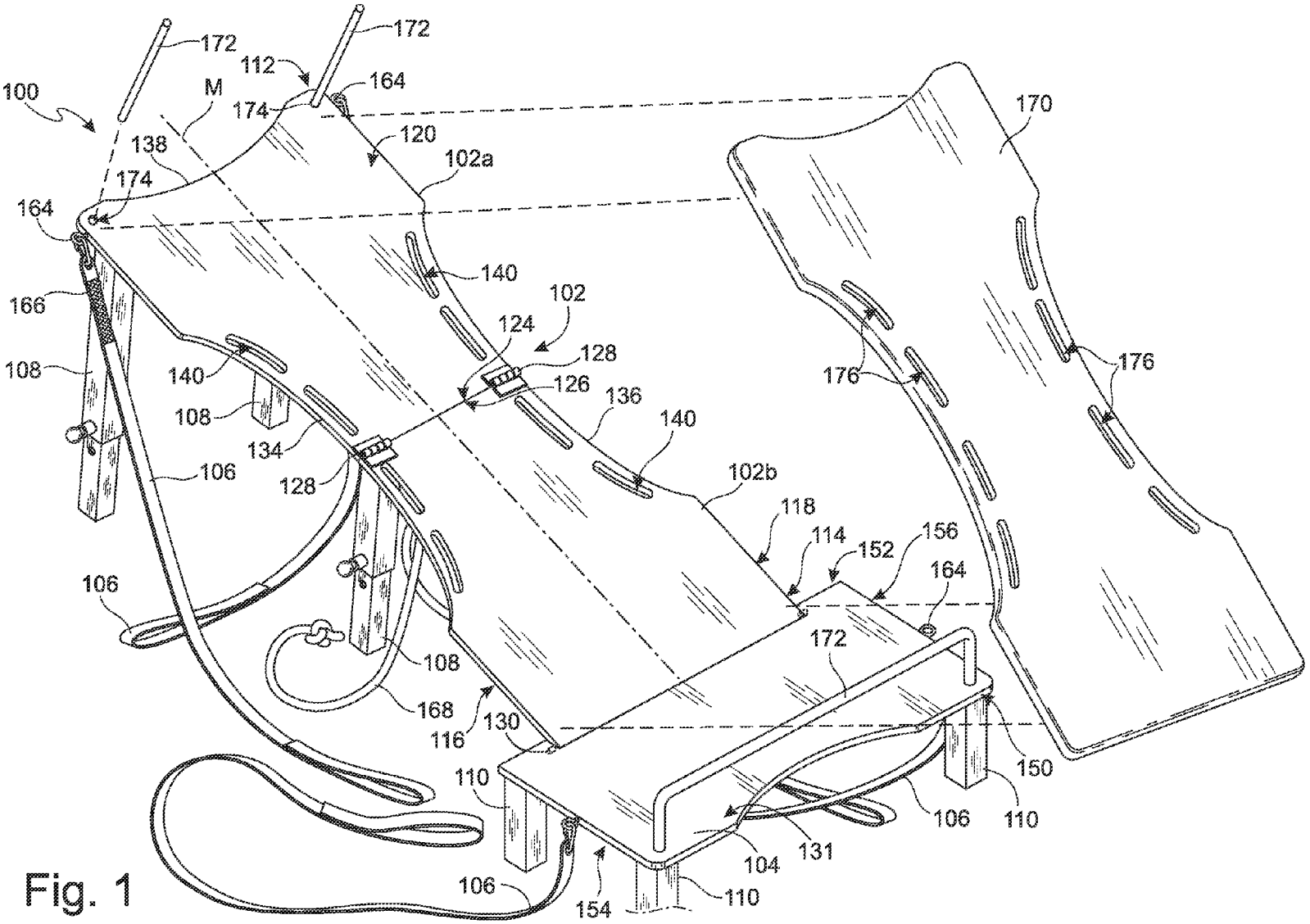
FIG. 1 is a top perspective view of an embodiment of the present invention.
Figure 2:
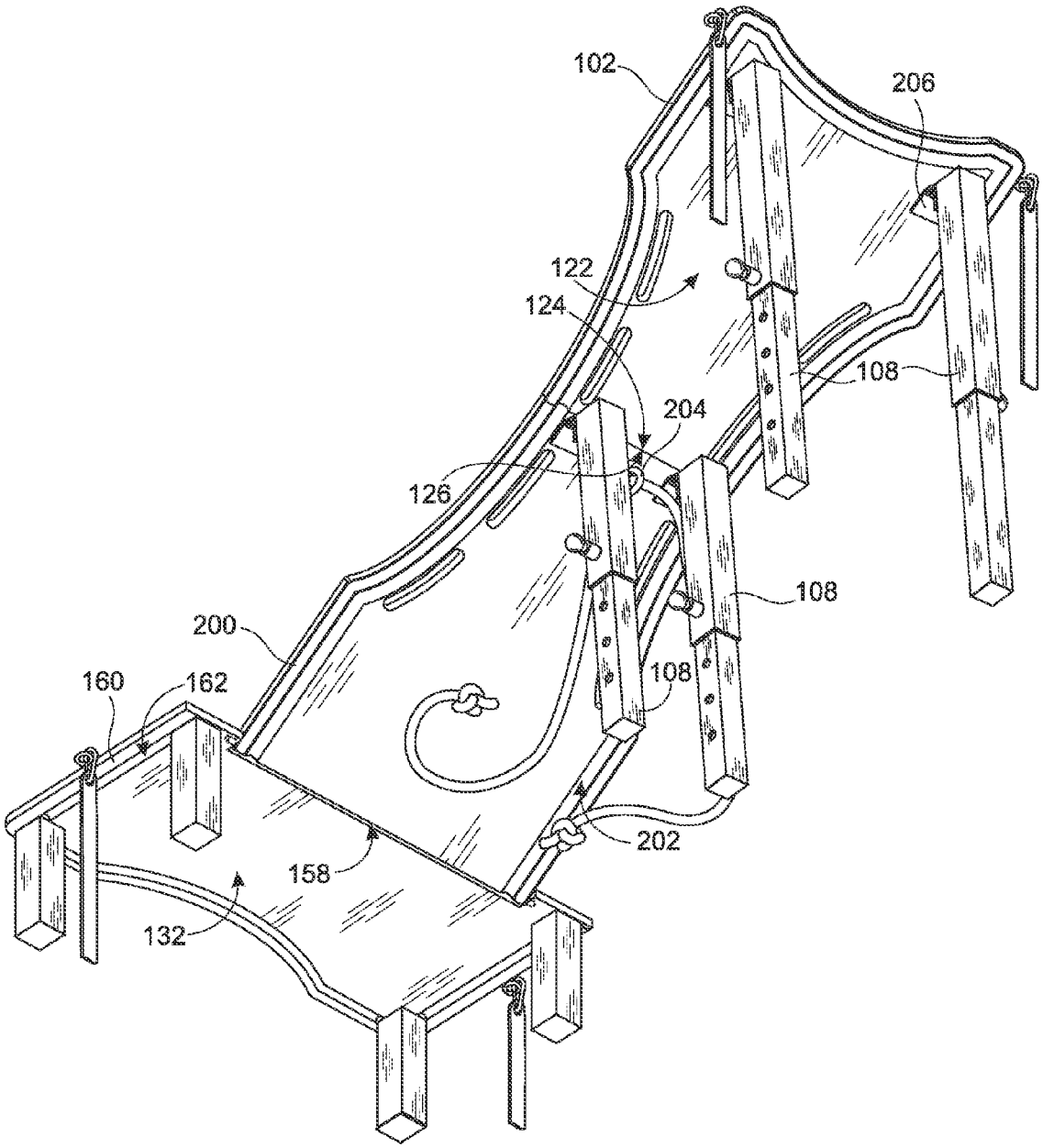
FIG. 2 is a bottom perspective view of an embodiment of the present invention.
Figure 3:
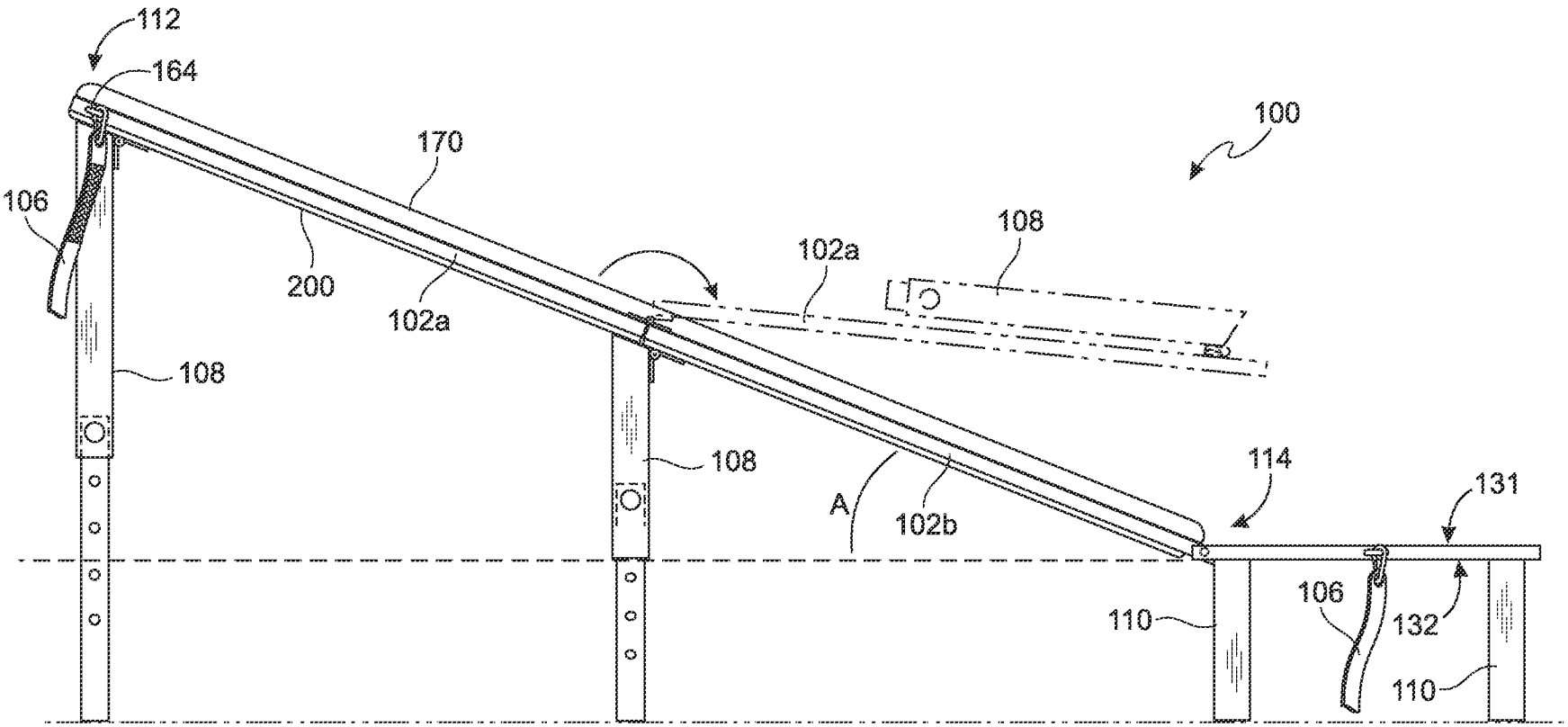
FIG. 3 is a side view of an embodiment of the present invention.

As shown in FIG. 1, the fitness board 100 comprises a deck 102, a base 104 connected to the deck 102, and a plurality of straps 106 connectable to the deck 102 and/or the base 104. In the preferred embodiment, the deck 102 and base 104 are elevated off the ground by legs 108 and 110. The legs 108, 110 may be telescoping and/or foldable.

The deck 102 is a flat board or platform that is generally rectangular in shape, having a first end 112 and a second end 114 opposite the first end 112, two opposing side edges 116, 118 adjacent to the first and second ends 112, 114, a top surface 120, and a bottom surface 122 opposite the top surface 120. Other shapes may also be used such as circular, oval, square, and the like. In some embodiments, the deck 102 may be divided into two portions, an upper deck portion 102*a* and a lower deck portion 102*b*. The upper deck portion 102*a* and the lower deck portion 102*b* may be mirror images of each other. In some embodiments, the upper deck portion 102*a* and the lower deck portion 102*b* are separate and independent pieces connected to each other at their respective medial ends 124, 126. The connection may be through a hinge mechanism 128 so as to allow the upper deck portion 102*a* to fold on top of the lower deck portion 102*b*. In some embodiments, the upper deck portion 102*a* and the lower deck portion 102*b* may be a single, integral piece.

In some embodiments, the upper deck portion 102*a* and the lower deck portion 102*b* may be slidably or telescopically connected to each other at their respective medial ends 124, 126. This allows the user to elongate or shorten the length of the deck 102. In some embodiments, the upper and lower deck portions may be separable from each other, thereby creating a gap. That gap may be filled by an intermediate deck piece to elongate the length of the deck.

The deck 102 is connected to the base 104 at the lower deck portion 102*b*. The connection between the deck 102 and the base 104 may be through a hinge 130 so as to allow the base 104 to fold on top of the lower deck portion 102*b*. In addition, the hinged connections between the lower deck portion 102*b* and the base 104 allows the deck 102 to rotate relative to the base 104 so as to be inclinable or declinable. Therefore, the user can adjust the angle of incline A of the deck 102 relative to the base 104 so as to adjust the degree of difficulty of an exercise performed on the deck 102.

The adjustment of the angle of incline A of the deck 102 may be achieved through telescopic legs 108. For example, the upper deck portion 102*a* may have telescopic legs 108 extending downwardly from its bottom surface 122. By adjusting the height of these legs 108 the deck 102 can raise up and down relative to the base 104, thereby changing the angle of incline A of the deck 102 relative to the base 104. Fixed legs of different sizes may also be used interchangeably to change the direction of the upper deck portion 102*a*. The base 104 may also have telescoping or fixed legs 110 attached to its bottom surface 132 so as to raise the base 104 off the ground. This also allows the upper deck portion 102*a* to dip below the base 104 so as to decline relative to the base 104. Therefore, the deck 102 can decline, incline, or be flat relative to the base 104.

The elevation of the deck 102 and base 104 can be modified to any height to suit the user's needs. For example, the first end 112 of the deck 102 may range from being on the ground to approximately 48 inches off the ground, and any elevation therebetween. The base 104 may range from being on the ground to approximately 20 inches off the ground, and any elevation therebetween. Again, depending on the use, the elevation of either the deck 102 or base 104 can be even greater.

At least a portion of the side edges 134, 136 of the deck 102 may be scalloped or concaved inwardly or medially toward the center or midline M of the deck 102, forming somewhat of an hourglass shape when viewed from the top. In some embodiments, the entire side edges 116, 118 may be curved or concaved inwardly or medially. The concavity along the side edges 116, 118 allows the user to adjust the width of his grip as well as the angle of his hand position relative to his body. The narrowing of the deck 102 also makes it easier for the user to straddle the deck 102. These various positions and angles allow different muscles to be isolated during exercise. In addition, a portion 138 or all of the first end 112 may be scalloped or concave.

Although the scallop or concavity may be used as a hand positioning adjustment means, other means for hand position adjustment can also be used. For example, rather than a smooth concave curvature along the side edges 116, 118 of the deck 102, there may be any form of gradual tapering or stepped tapering towards the center of the deck from the first or second ends 112, 114 towards the medial ends 124, 126 of the deck 102. For example, rather than a smooth concave curvature, the side edges 116, 118 may form a triangular wedge or a staircase shape. Alternatively, the concavity may be contoured.

In some embodiments, in addition to or in lieu of the side edges 116, 118 concaving inwardly, the deck 102 may have cutouts 140 between the side edges 116, 118 and the midline M of the deck 102. The cutouts 140 may be in a concave curvature configuration to parallel any concave or scalloped portions 134, 136 of the side edges 116, 118. The cutout 140 may be a single concave curvature. In some embodiments, there may be a series of cutouts 140 strategically positioned along the deck to facilitate various positioning of the hand to allow the user to grab underneath the deck. The cutouts 140 may be any shape, such as circular, oval, triangular, rectangular, square, crescent, and the like to allow the user to reach underneath the deck 102.

In some embodiments, the bottom surface 122 of the deck 102 may have a rail 200 along the perimeter of the top of deck 102. The rail 200 provides a structure for the user to hold on to while sitting or standing on top the deck 102 and reaching underneath the deck 102 for support. In some embodiments, the bottom surface 122 of the deck 102 may have a groove or channel 202 along at least a portion of the perimeter of the deck 102 to facilitate grabbing the bottom surface 122 of the deck 102. In some embodiments, the bottom surface 122 of the deck 102 may have both a rail 200 and a channel 202 along the perimeter of the deck 102. The rail 200 and/or channel 202 may extend throughout the entire perimeter of the deck. In some embodiments, rails 200 or channels 202 may be strategically positioned only along portions of the deck 102 most commonly used for grabbing. In some embodiments, the rails 200 or channels 202 may be contoured so as to ergonomically receive individual fingers for better comfort. In embodiments utilizing a cutout 140, the rail 200 and/or groove 202 would parallel the wall surface defining the cutout 140 so that at each cutout 140 the user will have something to grasp on the bottom 122 surface of the deck 102.

The deck 102 may be made from any rigid material such as wood, plastic, metal, and the like, or any combination thereof. In some embodiments, the deck 102 may have a slight elasticity or springiness to give the user a subtle bounce while exercising on the deck 102.

The base 104 is generally rectangular in shape and movably attached to the lower deck portion 102*b*. However, other shapes can also be used, such as circular, oval, square, and the like. The base 104 comprises a distal end 150, a proximal end 152 opposite the distal end 150 that connects to the lower deck portion 102*b*, and two side ends 154, 156 opposite each other and adjacent to the distal and proximal ends 150, 152. The proximal 152, distal 150, and side ends 154, 156 define a top surface 131 and a bottom surface 132 of the base 104. In the preferred embodiment, the width of the base (i.e. the distance between the two side ends 154, 156) is longer or wider than the width of the deck (i.e. the distance between the side edges 116, 118 of the deck, 102), thereby forming a "T" shape. The "T" formation provides additional places to grab the base 104 at its proximal end 152.

A portion or all of the distal end 150 of the base 104 may be scalloped or concave. The proximal end 152 attaches to the deck 102. A portion of the proximal end 152 may have a recess 158 into which the second end 114 of the deck 102 can be inserted. Therefore, the width of the recess 158 is slightly larger than the width of the deck 102. Pegs, dowels, lugs and the like can be used to rotatably fastened the base 104 to the lower deck portion 102*b* via the recess 158. This allows the base 106 to fold up on top of the lower deck portion 102*b*.

The base 104 may also have a rail 160 and/or a channel 162 along at least a portion the perimeter of the bottom surface 132 of the base 104 similar to the deck 102 to facilitate grabbing the bottom surface 132 of the base 104.

A mat 170 may be used to place on the top surface 120 of the deck 102 and/or base 104. The mat 170 may be made of a variety of materials that can provide comfort, a nonslip surface, and/or protection to the underlying surface. The mat 170 may be permanently secured to the top surface through various adhesives, such as glue, or removably secured, for example by hook and loop fasteners, so as to be replaceable. In embodiments in which the deck 102 is a two piece, the mat may also be a two-piece. In embodiments in which the deck 102 has cutouts 140, the mat 170 may have corresponding cutouts 176 so that the user can use the cutouts 140 of the deck 102 even though the mat 170 is placed on top of the deck 102.

Straps 106 may be attached at various positions along the deck 102 and/or base 104. For example, straps 106 may be fastened to the first end 112 of the upper deck portion 102*a*, the second end 114 of the lower deck portion 102*b*, or anywhere along the base 104. In these positions, the connection points 164 of the straps 106 are unlikely to interfere with other exercises as the user is unlikely to place his hands at those areas of the fitness board. Nonetheless, the straps 106 may be connected anywhere along the deck 102 or the base 104 as the user can work around the connection points 164.

The straps 106 allow the user to maintain stability and balance while on the fitness board 100. For example, a pair of straps 106 may be attached to the first end 112 of the deck 102. A person standing at the first end 112 can grasp both straps 106 and pull the straps 106 taut with each hand. The user can then lean towards the decline and perform single leg lunges or some other exercise movement. If the user feels unbalanced and begins falling toward one side, he can pull on the strap 106 on the other side to bring his body back to a balanced position.

In some embodiments, a portion of the strap 166 or the entire strap may be elastic. This allows the user to perform various resistance exercises. Elastic portions 166 of varying tension can be used to change the resistance on the straps 106.

A rope 168 may also be attached to the deck 102 or base 104. Preferably, the rope 168 is attached to the bottom surface 122 the deck 102. More preferably, the rope 168 is attached to the deck 102 at about its midpoint. The attachment to the deck may be via an eyeloop 204 so as to allow the rope 168 to move through the eyeloop 204. The rope 168 can be replaced with an elastic or non-elastic strap. Like the straps, the rope 168 provides stability and resistance.

In some embodiments, bars 172 may be used as attachments or for exercise, balance, or stretch. In some embodiments, the bars 170 may be removably attachable to the deck 102 or base 104. For example, the deck 102 may have recesses 174 into which the bars 172 can be inserted. The bars 172 can then be held by the user for balance. The bars 172 may protrude from the top surface 120 of the deck 102 or base 104, from the first end 112, the side edges 116, 118, or from any of the exposed edges of the base 150 or even the bottom of the deck 102 or base 104.

The bars 172 can be any shape and size. For example, the bar 172 may be a simple straight bar that can be inserted into a recess 174 so that the bar 172 protrudes up perpendicularly from the deck 102 or base 104. The user can grab the bar 172 for balance, support, or resistance. The straight bar may also be used for swinging in a variety of motions to exercise the arms while balancing on the deck 102.

The bar 172 may also be V-shape, L-shape, U-shape, T-shape, etc. to be inserted into the deck 102 or base 104 for support or resistance. The bars 172 may be fastened inside the recess by a variety of known means, such as resistance fit, pegs, bayonet twist lock, etc.

The legs 108, 110 of the fitness board 100 can be adjustable or telescopic to adjust the height of the deck 102 and/or base 104. The legs 108, 110 may also be foldable for convenient storage and transportation through a hinge 206. In some embodiments, the base 104 may not utilize legs and rest on the ground. By having at least the deck elevated, the user can use the negative space below the tangible exercise surface. Such utilization of negative space cannot be achieved on yoga mats and the like. Being able to utilize the negative space increases the variety and intensity of exercises and stretches that can be achieved.

In use, the user can perform a number of different exercises and stretches. As one example of a stretch, the user can adjust the length of the legs 108 to make the deck 102 flat and parallel to the base 104. The user can then sit near the second end 114 of the deck 102 with his legs stretched towards the first end 112 of the deck 102. Under normal circumstances in which the user stretches on the ground or on a mat, the user would only be able to utilize his upper body weight to stretch his legs. Depending on his flexibility user may be able to grab his legs and pull himself forward. Using the fitness board 100, however, allows the user to grab the side edges 116, 118 of the deck 102 and slowly walk his hands up towards his feet for a gradual and controlled stretch. To get a better stretch of his back, the user can reach down below the deck into the negative space, which cannot be done on yoga mats or on the floor. In addition, or alternatively, the user to grasp one of the straps 106 to pull himself forward for a stretch.

For a more facilitated stretch, the user can sit at the first end 112 and face the second end 114 with the deck 102 inclined relative to the base 104. For stability and control the user can grab a pair of nearby straps 106 and hold the straps 106 taut over his shoulders, and if preferred, across his chest. The user can slowly release his grip on the straps 106 to allow gravity to pull his body forward towards his feet, thereby providing a stretch of the hamstrings. If the user feels unbalanced, for example, he feels as if he is falling to the left or to the right, then he can pull on the opposite strap to prevent him from falling off to the sides.

In terms of exercise, a number of different isometric as well as isotonic exercises can be performed. As one example, the user can stand at the first end 112 of the deck 102 facing towards the second end 114 of the deck 102 with the first end 112 of the deck 102 elevated above the base 104. He can grab two straps 106 attached to the first end 112 of the deck 102 and sling them taut over his shoulders for balance. He can then alternatingly lunge forward with one leg then the other to perform modified lunges on a decline while maintaining balance by pulling on the appropriate strap 106 behind him For easier lunges, the user can stand at the second end 114 of the deck 102 facing towards the first end 112 of the deck 102 and lunge on the incline. Again, the user can hold onto straps behind him and across his shoulders for balance and stability.

For various exercises that may require sitting on the deck 102 the user is able to conveniently and comfortably dangle his legs or arms below the deck 102 due to the scallops 134, 136. In addition, due to the curved nature of the scallops 134, 136 the user can utilize various hand positions during exercise. For example, the user can perform a traditional push-up with this palm down and his fingers facing forward by placing a hand flat on the deck 102 or his fingers curled over the first end 112. Alternatively, the user can perform a push-up with his palms facing towards each other by grabbing the side edges 116, 118 of the deck 102. Due to the curvature of the scallops, the user can also position his hands anywhere therebetween. By changing the angle of incline A, the user can change the intensity of the push-up.

Being elevated off the ground, the user can effectively use the negative space below the deck. For example, the user can lay flat on his stomach with his hips at the first end 112 and his feet towards the second end 114. He can then dip his upper body below the deck 102 and raise it back up thereby exercising his lower back muscles. The user can also grab the straps 106 connected to the base or place his heels under the deck 102 support. Placing his heels under the deck 102 is further facilitated by the scalloped side edges 134, 136. The user could also hook his feet under a strategically placed bar 172.

The user can also exercise his neck by lying on his back and hanging his head over any edge and raising his head up and down into and out of the negative space. Dips can be performed in the scalloped regions as well.

User can even perform exercises underneath the fitness board. For example, the user can lie underneath the board facing up. The user can then grab the edges 116, 118 of the deck 102 and lift himself up. To increase the intensity, the user can wrap his legs around the edges 116, 118 and rest them on the top surface 120 of the deck 102 or base 104 so that his entire body is suspended. To more easily wrap his legs around the board, the user can wrap his legs around the scalloped portion of the side edges 134, 136. Alternatively, the user can grasp various positions on the scalloped portions to vary the width of his arms to target different muscles. If various bars 172 are protruding from the deck 102 or base 104, the user can grasp those or rest his legs on those as well.

These are but a small sample of the various exercises that can be performed on the fitness board 100. An unlimited number of exercises and stretches, both isotonic and isometric in nature, can be performed on, adjacent to, or even underneath the exercise board 100.

The foregoing description of the preferred embodiment of the invention has been presented for the purposes of illustration and description. It is not intended to be exhaustive or to limit the invention to the precise form disclosed. Many modifications and variations are possible in light of the above teaching It is intended that the scope of the invention not be limited by this detailed description, but by the claims and the equivalents to the claims appended hereto.

What is claimed is:

1. An exercise board, comprising:

a. a deck upon which a user can utilize the forces of gravity and his own body positioning to conduct a variety of different exercises to strengthen and develop a variety of different muscle groups, wherein the deck is a flat platform that is generally rectangular in shape, having a first end and a second end opposite the first end, two opposing side edges adjacent to the first and second ends, a top surface, and a bottom surface opposite the top surface, and wherein at least a portion of both side edges of the deck are concaved inwardly, wherein the deck, comprises an upper deck portion and a lower deck portion, wherein the upper deck portion and the lower deck portion are separate and independent pieces, each comprising a medial end, wherein the upper deck portion and the lower deck portion are connected to each other at their respective medial ends with a first hinge, wherein the deck has an elastic property to allow the user to bounce on the deck;

b. a base connected to the deck, wherein the base comprises a distal end, a proximal end opposite the distal end, and two side ends opposite each other and adjacent to the distal and proximal ends the proximal, distal, and side ends defining a to surface and a bottom surface of the base, wherein at least a portion the distal end of the base is concave towards the deck, wherein the deck is connected to the proximal end of the base with a second hinge so as to allow the deck to move relative to the base to adjust an angle of incline of the deck relative to the base;

c. a plurality of straps connectable to the deck or the base;

d. a rope connected to the deck, wherein the rope is attached to the bottom surface of the deck at a point midway between the two opposing side edges of the deck via an eyeloop so as to allow the rope to move through the eyeloop;

e. a bar attachable to the deck;

f. a rail along at least a portion of a perimeter of the deck to facilitate grabbing the bottom surface of the deck; and g. a plurality of legs connected to the deck and the base to elevate the deck and the base, wherein the legs are telescoping.

2. The exercise board of claim 1, further comprising a mat substantially similar in shape to the deck to be placed on the top surface of the deck.

3. The exercise board of claim 1, further comprising a cutout medial to and along at least one of the side edges of the deck.

4. The exercise board of claim 1, further comprising a groove formed on the bottom surface of the deck along a portion of a perimeter of the deck to facilitate grabbing the bottom surface of the deck.

5. The exercise board of claim 1, wherein at least a portion of one of the plurality of straps is elastic.

* * * * *